US010957987B2

(12) United States Patent
Hildebrand et al.

(10) Patent No.: US 10,957,987 B2
(45) Date of Patent: Mar. 23, 2021

(54) SPACE DEPLOYABLE INFLATABLE ANTENNA APPARATUS AND ASSOCIATED METHODS

(71) Applicant: HARRIS CORPORATION, Melbourne, FL (US)

(72) Inventors: Robert C Hildebrand, Melbourne, FL (US); William C Adams, West Melbourne, FL (US)

(73) Assignee: HARRIS CORPORATION, Melbourne, FL (US)

( * ) Notice: Subject to any disclaimer, the term of this patent is extended or adjusted under 35 U.S.C. 154(b) by 348 days.

(21) Appl. No.: 15/210,118

(22) Filed: Jul. 14, 2016

(65) Prior Publication Data

US 2018/0019520 A1 Jan. 18, 2018

(51) Int. Cl.
*H01Q 1/08* (2006.01)
*H01Q 15/16* (2006.01)
(Continued)

(52) U.S. Cl.
CPC ..... *H01Q 15/163* (2013.01); *H01Q 1/081* (2013.01); *H01Q 1/288* (2013.01); *H01Q 3/04* (2013.01);
(Continued)

(58) Field of Classification Search
CPC ..... H01Q 15/163; H01Q 1/081; H01Q 1/288; H01Q 3/04; H01Q 9/22; H01Q 15/161; H01Q 15/20; H01Q 19/30; H01Q 9/16
(Continued)

(56) References Cited

U.S. PATENT DOCUMENTS 2,853,706 A 9/1958 Trench et al.
3,202,998 A * 8/1965 Hoffman ..... H01Q 1/08 343/833
(Continued)

FOREIGN PATENT DOCUMENTS

GB 1007071 10/1965
JP H03154502 7/1991
KR 101393097 B1 * 5/2014 ..... H01Q 1/082

OTHER PUBLICATIONS

Schnek et al. "Review of Inflatable Booms for Deployable Space Structures: Packing and Rigidization", Journal of Spacecraft and Rockets, (2014) (Year: 2014).*
(Continued)

*Primary Examiner* — Daniel Munoz
*Assistant Examiner* — Bamidele A Jegede
(74) *Attorney, Agent, or Firm* — Allen, Dyer, Doppelt + Gilchrist, P.A.

(57) ABSTRACT

A space deployable antenna apparatus includes an inflatable antenna configurable between a deflated storage position and an inflated deployed position. The inflatable antenna includes collapsible tubular elements coupled together in fluid communication. The collapsible tubular elements in the deployed position include a longitudinally extending boom tubular element, at least one driven tubular conductive element transverse to the boom tubular element, at least one reflector tubular conductive element transverse to the boom tubular element, and at least one director tubular conductive element transverse to the boom tubular element. A foam dispenser is configured to inject a solidifiable foam into the inflatable antenna to configure to the inflated deployed position.

21 Claims, 3 Drawing Sheets

(51) Int. Cl.

| | |
|---|---|
| ***H01Q 19/30*** | (2006.01) |
| ***H01Q 1/28*** | (2006.01) |
| ***H01Q 3/04*** | (2006.01) |
| ***H01Q 9/22*** | (2006.01) |
| *H01Q 9/16* | (2006.01) |

(52) U.S. Cl.
CPC ..... *H01Q 9/22* (2013.01); *H01Q 19/30* (2013.01); *H01Q 9/16* (2013.01)

(58) Field of Classification Search
USPC ..... 343/839
See application file for complete search history.

(56) References Cited

U.S. PATENT DOCUMENTS 3,364,488 A 1/1968 Perenic et al.
3,508,270 A * 4/1970 Cook ..... H01Q 1/288 343/705
3,530,469 A 9/1970 Dailey et al.
4,380,013 A * 4/1983 Slysh ..... H01Q 1/288 343/753
4,482,900 A * 11/1984 Bilek ..... H01Q 15/161 343/915
4,825,599 A 5/1989 Swann, Jr.
5,017,925 A * 5/1991 Bertiger ..... H01Q 1/081 342/352
5,040,918 A * 8/1991 Taricco ..... E02B 15/0885 405/66
5,163,262 A * 11/1992 Adams ..... B64G 9/00 52/111
5,196,857 A * 3/1993 Chiappetta ..... B64G 1/22 244/159.5
5,313,221 A 5/1994 Denton, Jr.
5,579,609 A * 12/1996 Sallee ..... B64G 9/00 156/156
5,886,672 A * 3/1999 Brune ..... H01Q 1/08 343/792.5
5,927,654 A * 7/1999 Foley ..... B64G 1/222 244/172.6
5,977,932 A * 11/1999 Robinson ..... B64G 1/22 16/226
5,990,851 A * 11/1999 Henderson ..... H01Q 1/081 343/840
5,992,120 A * 11/1999 Meguro ..... B64G 1/222 52/646
6,104,358 A * 8/2000 Parker ..... H01Q 15/161 343/915
6,219,009 B1 * 4/2001 Shipley ..... H01Q 1/288 343/912
6,343,442 B1 * 2/2002 Marks ..... B64G 1/222 244/172.6
6,373,449 B1 * 4/2002 Bokulic ..... H01Q 1/288 343/840
6,512,496 B2 * 1/2003 Alexeff ..... H01Q 1/04 343/878
6,791,510 B2 * 9/2004 Watanabe ..... B64G 1/222 343/897
6,963,315 B2 * 11/2005 Gierow ..... H01Q 1/081 343/872
7,126,553 B1 * 10/2006 Fink ..... H01Q 1/08 343/767
7,382,232 B2 6/2008 Essig, Jr. et al.
7,382,332 B2 6/2008 Essig, Jr. et al.
7,694,465 B2 4/2010 Pryor
8,730,124 B2 5/2014 Behrens et al.
9,214,722 B2 12/2015 Georgakopoulos et al.
9,973,266 B1 * 5/2018 Avellan ..... H04B 7/195
2003/0160733 A1 * 8/2003 Lee ..... H01Q 1/081 343/912
2004/0037167 A1 * 2/2004 Anderson ..... G01V 1/20 367/154
2004/0207566 A1 * 10/2004 Essig, Jr. ..... F21S 11/00 343/878
2005/0093754 A1 * 5/2005 Lyons ..... H01Q 1/081 343/706
2009/0019784 A1 * 1/2009 Tinker ..... E04B 1/3211 52/2.11
2009/0057492 A1 * 3/2009 Harris ..... B64G 1/24 244/164
2010/0101172 A1 * 4/2010 Murphy ..... B64G 1/222 52/646
2012/0019422 A1 * 1/2012 Gemeny ..... H01Q 1/085 343/749
2014/0028532 A1 * 1/2014 Ehrenberg ..... H01Q 1/1235 343/912
2014/0263844 A1 * 9/2014 Cook, Jr. ..... H02S 30/20 244/164
2015/0086270 A1 * 3/2015 Shany ..... E02B 15/06 405/63

OTHER PUBLICATIONS

Constantine et al. "Deployable antennas for CubeSat and space communications" 6th European Conference on Antennas and Propagation, EUCAP 2012, pp. 837-840.
Lichodziejewski et al. "Inflatably deployed membrane waveguide array antenna for space" American Institue of Aeronautics and Astronautics, Inc. AIAA 2003-1649: pp. 7.

* cited by examiner

SPACE DEPLOYABLE INFLATABLE ANTENNA APPARATUS AND ASSOCIATED METHODS

FIELD OF THE INVENTION

The present invention relates to the field of antennas, and more particularly, to an inflatable antenna for a spacecraft and related methods.

BACKGROUND

Deployable antennas are highly desirable in satellite and other space applications. In such applications, it is important for an antenna to be able to fit into a small space, but also be expandable to a fully operational size once orbit has been achieved.

The issue of antenna deployability is especially critical as the size of satellites get smaller. While the sensors and operating electronics of miniaturized satellites can be scaled to extremely small volumes, the wavelengths of the signals used by such miniaturized satellites to communicate do not scale accordingly. Given that the wavelength of a signal determines the size of an antenna used to communicate that signal, antennas for miniaturized satellites still have dimensions similar to those of larger satellites.

One approach for a space deployable antenna is disclosed in U.S. Pat. No. 6,791,510 where the antenna includes an inflatable structure, a plane antenna supported by the inflatable structure and a plurality of tensioning cables for supporting the plane antenna with the inflatable structure. When the antenna is initially placed in a satellite that is to be launched, the plane antenna and the inflatable structure are both stored inside a rocket fairing in their rolled or folded states. After the rocket is launched and the antenna is set on its satellite orbit, a gas or a urethane foam is filled into the inflatable structure to deploy the inflatable structure to its shape. The plane antenna, which is in the rolled or folded state, is extended and the tensioning cables pull uniformly on the membrane surface periphery of the plane antenna to extend it into a flat plane without distortions.

Yet another approach for an inflatable antenna is disclosed in U.S. published patent application no. 2014/0028532. The inflatable antenna includes an inflatable dish with a RF reflective main reflector and an opposing RF transparent dish wall. An inflatable RF transparent support member and an RF reflective subreflector extend from the dish wall. When the antenna is inflated, the main reflector and the subreflector oppose each other to reflect RF energy toward each other to form an antenna. A gas or a hardening foam may be used to fill the inflatable antenna.

Even in view of the above described inflatable antennas, there is still a need to reduce the weight of such antennas. For example, the cost/pound to launch a satellite in a low earth orbit (LEO) is about $10,000, whereas the cost/pound for a synchronous orbit is about $20,000. Consequently, any reduction in weight for a spaced based antenna may result in significant cost savings.

SUMMARY

In view of the foregoing background, it is therefore an object of the present invention to provide a lightweight inflatable antenna for a spacecraft.

This and other objects, features, and advantages in accordance with the present invention are provided by a space deployable antenna apparatus comprising an inflatable antenna configurable between a deflated storage position and an inflated deployed position and comprising a plurality of collapsible tubular elements coupled together in fluid communication. The plurality of collapsible tubular elements in the deployed position may comprise a longitudinally extending boom tubular element, at least one driven tubular conductive element transverse to said boom tubular element, at least one reflector tubular conductive element transverse to said boom tubular element, and at least one director tubular conductive element transverse to said boom tubular element. A foam dispenser may be configured to inject a solidifiable foam into the inflatable antenna to configure to the inflated deployed position.

An advantage of the foam filled inflatable antenna is that it is light weight as well as low cost. In addition, the inflatable antenna in the inflated deployed position is not impacted by rigid dimensional requirements.

The at least one driven tubular conductive element may comprise a dielectric tube and a pair of spaced apart conductive layers thereon, with each conductive layer having an antenna feed point. The space deployable antenna apparatus may further comprise a coaxial cable having inner and outer conductors coupled to respective ones of the antenna feed points.

The at least one reflector tubular conductive element may comprise a dielectric tube and a conductive layer thereon. Similarly, the at least one director tubular conductive element may comprise a dielectric tube and a conductive layer thereon.

The at least one driven tubular conductive element, the at least one reflector tubular conductive element and the at least one director tubular conductive element may be coplanar with each other when the inflatable antenna is in the deployed position.

The foam dispenser may comprise first and second foam component supplies. The space deployable antenna apparatus may further comprise a mixing valve coupled between the first and second foam component supplies and the inflatable antenna.

The plurality of collapsible tubular elements may comprise a biaxially-oriented polyethylene terephthalate (BoPET) film or a polyimide film, for example.

Another aspect is directed to a spacecraft comprising a transceiver, and a space deployable antenna apparatus coupled to the transceiver, as described above.

Yet another aspect is directed to a method for deploying an inflatable antenna in space. The method may comprise initially storing the inflatable antenna in a deflated storage position within the spacecraft. When in space, a solidifiable foam may be injected from the foam dispenser into the inflatable antenna to configure to an inflated deployed position, with the plurality of collapsible tubular elements being coupled together in fluid communication in the deployed position. The tubular elements may comprise a longitudinally extending boom tubular element, at least one driven tubular conductive element transverse to the boom tubular element, at least one reflector tubular conductive element transverse to the boom tubular element, and at least one director tubular conductive element transverse to the boom tubular element.

DETAILED DESCRIPTION

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Figure 1:
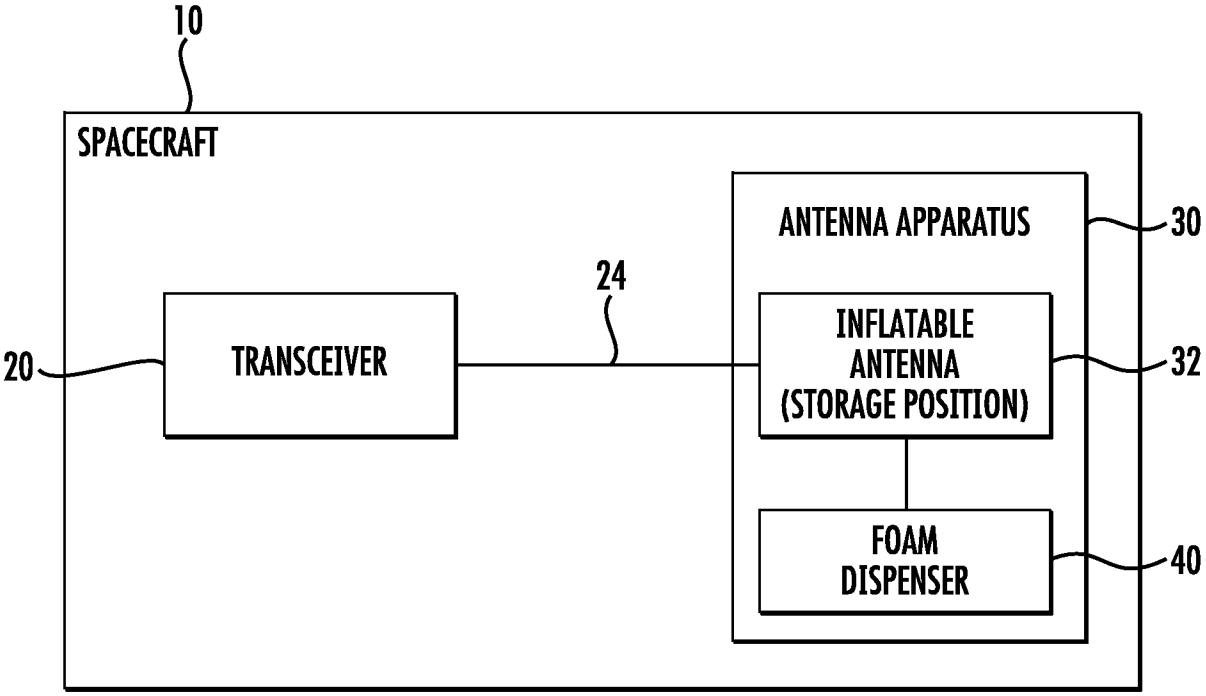
FIG. 1 is a block diagram of a spacecraft with an inflatable antenna in accordance with the present invention.

Referring initially to FIG. 1, a spacecraft 10 includes a transceiver 20, and a space deployable antenna apparatus 30 coupled to the transceiver via a coaxial cable 24. The space deployable antenna apparatus 30 includes an inflatable antenna 32 configurable between a deflated storage position and an inflated deployed position. A foam dispenser 40 is configured to inject a solidifiable foam into the inflatable antenna 32 to configure from the deflated storage position to the inflated deployed position.

Figure 2:
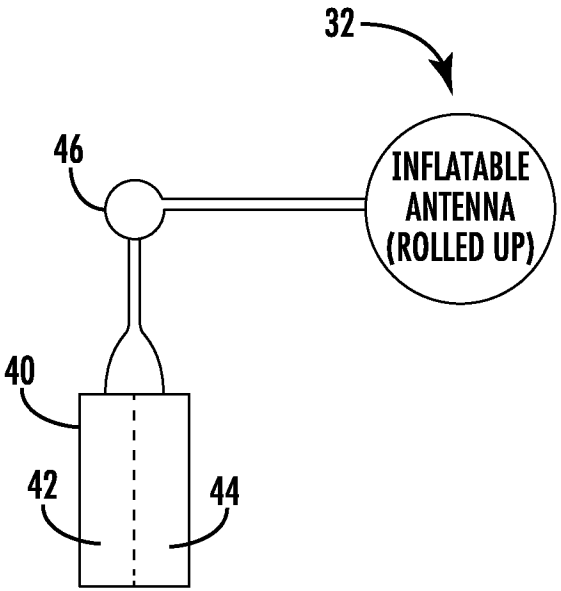
FIG. 2 is a block diagram of the inflatable antenna illustrated in FIG. 1 in a deflated storage position.

In the deflated storage position, the inflatable antenna 32 is rolled or folded up as illustrated in FIG. 2. In order to provide the smallest footprint as possible for launch of the spacecraft 10, the inflatable antenna 32 may initially be collapsed in a vacuum and then rolled up.

For the foam dispenser 40, a two-part foam may be used. In the illustrated embodiment, the foam dispenser 40 includes a first foam component supply 42 and a second foam component supply 44. A mixing valve 46 is coupled between the foam dispenser 40 and the inflatable antenna 32. The mixing valve 46 is used to mix together the contents of the first and second foam component supplies 42, 44.

The first and second foam component supplies 42, 44 may include different organic silicons, such as organopolyhydroxy siloxane and organopolyhydrogen siloxane, for example. In addition, one of the organic silicons has a catalyst mixed therein. The catalyst may be platinum, aminoxy or organic tin, for example. When the different organic silicons and the catalyst are mixed together in the mixing valve 46, a chemical reaction occurs. The chemical reaction generates hydrogen bubbles which causes the liquid silicon foam to expand.

When the foam dispenser 40 is activated, the contents of the first and second foam component supplies 42, 44 may be pushed by plungers into the mixing valve 46. Depending on the size of the inflatable antenna 32, it may take about 3 to 5 minutes to fill with the liquid foam. Depending on the temperature, it may take about 45 to 60 minutes for the liquid foam to solidify.

Figure 3:
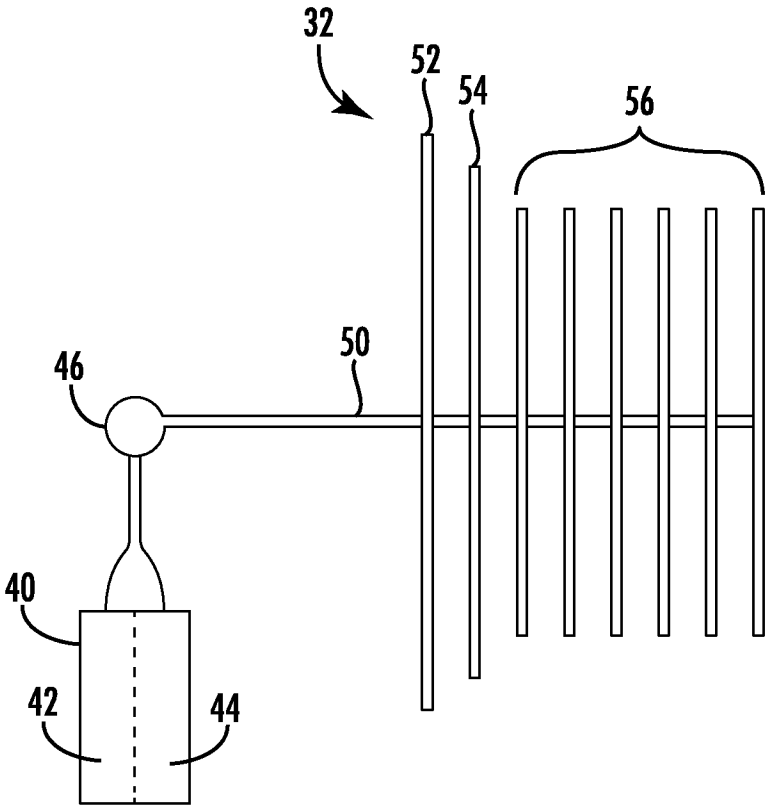
FIG. 3 is a block diagram of the inflatable antenna illustrated in FIG. 1 in an inflated deployed position.

As the liquid foam expands, the inflatable antenna 32 begins to roll out and expand to the inflated deployed position. As illustrated in FIG. 3, the inflatable antenna 32 is configured as a Yagi-Uda antenna.

An advantage of the foam filled inflatable antenna 32 is that it is light weight as well as low cost. In addition, the inflatable antenna 32 in the inflated deployed position is not impacted by rigid dimensional requirements.

More particularly, the inflatable antenna 32 comprises a plurality of collapsible tubular elements coupled together in fluid communication. The collapsible tubular elements in the deployed position comprise a longitudinally extending boom tubular element 50, at least one driven tubular conductive element 54 transverse to the boom tubular element, at least one reflector tubular conductive element 52 transverse to the boom tubular element, and at least one director tubular conductive element 56 transverse to the boom tubular element.

In the illustrated embodiment there are 6 director tubular conductive elements 56. As the number of conductive elements 56 increases, so does the gain of the Yagi-Uda antenna. TABLE 1 provides an approximate gain based on the number of director tubular conductive elements 56. The actual number of director tubular conductive elements 56 will vary depending on the intended application.

TABLE 1

APPROXIMATE YAGI-UDA GAIN LEVELS

| NUMBER OF ELEMENTS | APPROX ANTICIPATED GAIN DB OVER DIPOLE |
|---|---|
| 2 | 5 |
| 3 | 7.5 |
| 4 | 8.5 |
| 5 | 9.5 |
| 6 | 10.5 |
| 7 | 11.5 |

The inflatable antenna 32 is not limited to any particular frequency. The frequency depends on the intended application of the transceiver 20. As an example, the inflatable antenna 32 may be sized to operate at 450 MHz. At this frequency, the longitudinally extending boom tubular element 50 is about 5 feet in length and the reflector tubular conductive element 52 is about 13 inches in length. The length of the driven tubular conductive element 54 is about 12 inches, and the length of the director tubular conductive elements 56 is about 11 inches. A height and width of the boom tubular element 50 and the respective tubular conductive elements 52, 54, 56 are about 0.5 inches and 0.75 inches, respectively.

The inflatable antenna 32 may be formed out of two dielectric films or layers, where each dielectric layer has an outline corresponding to the Yagi-Uda antenna shape, as illustrated in FIG. 3. The two dielectric layers are joined together to form a dielectric tube with only one open end. The one open end is to receive the liquid silicon foam. The two dielectric layers may be welded together, for example. The dielectric layers are about 1 to 3 mils thick, for example.

At least one of the dielectric layers has a plurality of conductive layers thereon. The conductive layers may be aluminum, copper or gold, for example. The conductive layers may be laminated, printed on, or applied with an adhesive onto the dielectric layer, as readily appreciated by those skilled in the art.

Figure 4:
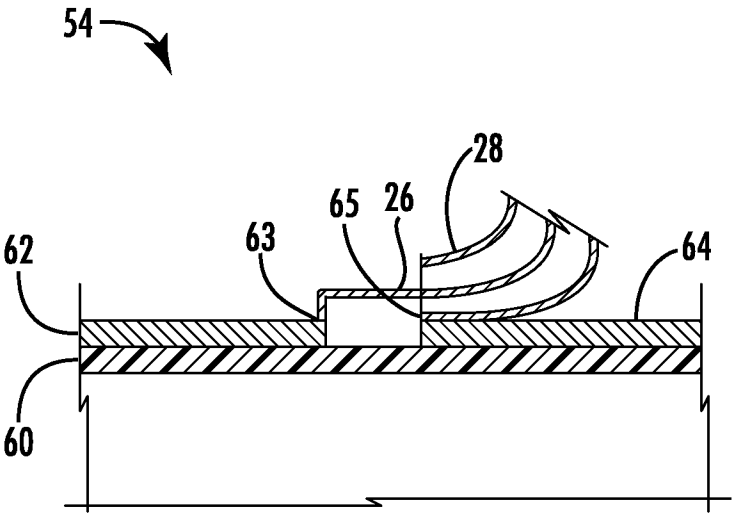
FIG. 4 is a cross-sectional view of a driven tubular conductive element when the inflatable antenna is in the inflated deployed position, as illustrated in FIG. 3.

Referring now to FIG. 4, the driven tubular conductive element 54 comprises a dielectric tube 60 and a pair of spaced apart conductive layers 62, 64 thereon, with each conductive layer having an antenna feed point 63, 65. A coaxial cable 24 has inner and outer conductors 26, 28 coupled to respective ones of the antenna feed points 63, 65.

Figure 5:
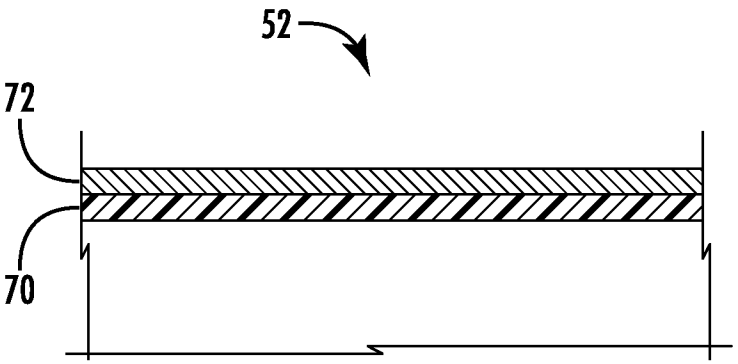
FIG. 5 is a cross-sectional view of a reflector tubular conductive element when the inflatable antenna is in the inflated deployed position, as illustrated in FIG. 3.
Figure 6:
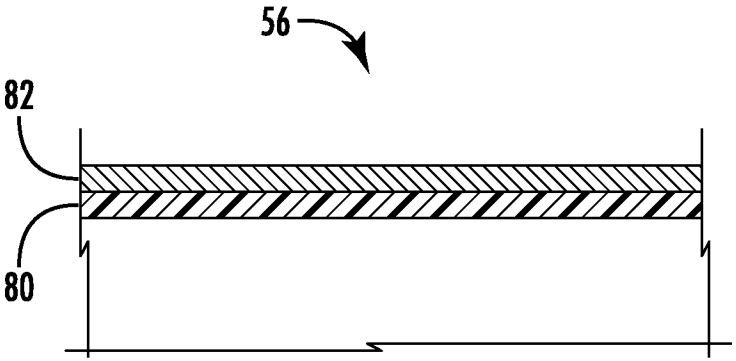
FIG. 6 is a cross-sectional view of a director tubular conductive element when the inflatable antenna is in the inflated deployed position, as illustrated in FIG. 3.

Referring now to FIG. 5, the reflector tubular conductive element 52 comprises a dielectric tube 70 and a conductive layer 72 thereon. Similarly, each director tubular conductive element 56 comprises a dielectric tube 80 and a conductive layer 82 thereon, as illustrated in FIG. 6.

When the inflatable antenna 32 is in the deployed position, the driven tubular conductive element 54, the reflector tubular conductive element 52 and the director tubular conductive elements 56 are coplanar with each other.

The dielectric layers of the inflatable antenna 32 may be made out of Mylar™ or Kapton™, for example. Mylar™ is a polyester film, and more particularly, is a biaxially-oriented polyethylene terephthalate (BoPET) film. Kapton™ is a polyimide film and remains stable across a wide range of temperatures, from −269 to +400° C.

Another aspect is directed to a method for deploying an inflatable antenna 32 in space. The method comprises initially storing the inflatable antenna 32 in a deflated storage position within the spacecraft 10. When in space, a solidifiable foam is injected from the foam dispenser 40 into the inflatable antenna 32 to configure to an inflated deployed position, with the plurality of collapsible tubular elements being coupled together in fluid communication in the deployed position. The tubular elements comprise a longitudinally extending boom tubular element 50, at least one driven tubular conductive element 54 transverse to the boom tubular element, at least one reflector tubular conductive element 52 transverse to the boom tubular element, and at least one director tubular conductive element 56 transverse to the boom tubular element.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. An outer space deployable antenna apparatus comprising:

an inflatable antenna configurable between a deflated storage position and an inflated deployed position in outer space and comprising a plurality of collapsible tubular elements coupled together in fluid communication, said plurality of collapsible tubular elements in the deployed position in outer space comprising a longitudinally extending boom tubular element having a proximal end and a free floating distal end, at least one driven tubular conductive element having opposing free floating ends and transverse to said boom tubular element, and comprising a dielectric tube and a pair of spaced apart conductive layers thereon, with each conductive layer having an antenna feed point, at least one reflector tubular conductive element having opposing free floating ends and transverse to said boom tubular element, and at least one director tubular conductive element having opposing free floating ends and transverse to said boom tubular element; and a foam dispenser configured to inject a solidifiable foam into said inflatable antenna to configure to the inflated deployed position in outer space.

2. The outer space deployable antenna apparatus according to claim 1 further comprising a coaxial cable having inner and outer conductors coupled to respective ones of the antenna feed points.

3. The outer space deployable antenna apparatus according to claim 1 wherein said at least one reflector tubular conductive element comprises a dielectric tube and a conductive layer thereon.

4. The outer space deployable antenna apparatus according to claim 1 wherein said at least one driven tubular conductive element, said at least one reflector tubular conductive element and said at least one director tubular conductive element are coplanar with each other when said inflatable antenna is in the deployed position.

5. The outer space deployable antenna apparatus according to claim 1 wherein said foam dispenser comprises first and second foam component supplies.

6. The outer space deployable antenna apparatus according to claim 5 further comprising a mixing valve coupled between said first and second foam component supplies and said inflatable antenna.

7. The outer space deployable antenna apparatus according to claim 1 wherein said plurality of collapsible tubular elements comprises a biaxially-oriented polyethylene terephthalate (BoPET) film.

8. The outer space deployable antenna apparatus according to claim 1 wherein said plurality of collapsible tubular elements comprises a polyimide film.

9. A spacecraft comprising:

a transceiver; and an outer space deployable antenna apparatus coupled to said transceiver and comprising an inflatable antenna configurable between a deflated storage position and an inflated deployed position in outer space and comprising a plurality of collapsible tubular elements coupled together in fluid communication, said plurality of collapsible tubular elements in the deployed position in outer space comprising a longitudinally extending boom tubular element having a proximal end and a free floating distal end, at least one driven tubular conductive element having opposing free floating ends and transverse to said boom tubular element, and comprising a dielectric tube and a pair of spaced apart conductive layers thereon, with each conductive layer having an antenna feed point, at least one reflector tubular conductive element having opposing free floating ends and transverse to said boom tubular element, and at least one director tubular conductive element having opposing free floating ends and transverse to said boom tubular element; and a foam dispenser configured to inject a solidifiable foam into said inflatable antenna to configure to the inflated deployed position in outer space.

10. The spacecraft according to claim 9 further comprising a coaxial cable coupled between said transceiver and said at least one driven tubular conductive element, with said coaxial cable having inner and outer conductors coupled to respective ones of the antenna feed points.

11. The spacecraft according to claim 9 wherein said at least one reflector tubular conductive element comprises a dielectric tube and a conductive layer thereon.

12. The spacecraft according to claim 9 wherein said at least one driven tubular conductive element, said at least one reflector tubular conductive element and said at least one director tubular conductive element are coplanar with each other when said inflatable antenna is in the deployed position.

13. The spacecraft according to claim 9 wherein said foam dispenser comprises first and second foam component supplies.

14. The spacecraft according to claim 13 further comprising a mixing valve coupled between said first and second foam component supplies and said inflatable antenna.

15. The spacecraft according to claim 9 wherein said plurality of collapsible tubular elements comprises at least one of a biaxially-oriented polyethylene terephthalate (BoPET) film and a polyimide film.

16. A method for deploying an inflatable antenna in outer space comprising:

storing the inflatable antenna in a deflated storage position; and when in outer space injecting a solidifiable foam from a foam dispenser into the inflatable antenna to configure to an inflated deployed position in outer space, with the plurality of collapsible tubular elements being coupled together in fluid communication in the deployed position in outer space and comprising a longitudinally extending boom tubular element having a proximal end and a free floating distal end, at least one driven tubular conductive element having opposing free floating ends and transverse to said boom tubular element, and comprising a dielectric tube and a pair of spaced apart conductive layers thereon, with each conductive layer having an antenna feed point, at least one reflector tubular conductive element having opposing free floating ends and transverse to said boom tubular element, and at least one director tubular conductive element having opposing free floating ends and transverse to said boom tubular element.

17. The method according to claim 16 further comprising a coaxial cable having inner and outer conductors coupled to respective ones of the antenna feed points.

18. The method according to claim 16 wherein the at least one reflector tubular conductive element comprises a dielectric tube and a conductive layer thereon.

19. The method according to claim 16 wherein said at least one driven tubular conductive element, the at least one reflector tubular conductive element and the at least one director tubular conductive element are coplanar with each other when the inflatable antenna is in the deployed position.

20. The method according to claim 16 wherein the foam dispenser comprises first and second foam component supplies, and further comprising a mixing valve coupled between the first and second foam component supplies and the inflatable antenna.

21. The method according to claim 16 wherein the plurality of collapsible tubular elements comprises at least one of a biaxially-oriented polyethylene terephthalate (BoPET) film and a polyimide film.

* * * * *